US005367771A

United States Patent [19]

Mukai

[11] Patent Number: 5,367,771

[45] Date of Patent: Nov. 29, 1994

[54] ELECTRIC SHAVER WITH TWO ROWS OF OUTER BLADES

[75] Inventor: Kiyotaka Mukai, Sumoto, Japan

[73] Assignee: Sanyo Electric Co., Ltd., Osaka, Japan

[21] Appl. No.: 59,270

[22] Filed: May 11, 1993

[30] Foreign Application Priority Data

May 13, 1992 [JP] Japan ..... 4-120697
Jul. 28, 1992 [JP] Japan ..... 4-201165

[51] Int. Cl.[5] ..... B26B 19/02
[52] U.S. Cl. ..... 30/43.92; 30/43.91
[58] Field of Search ..... 30/34.1, 41.6, 43.3, 30/43.9, 43.91, 43.92, 50, 77

[56] References Cited

U.S. PATENT DOCUMENTS 4,292,737 10/1981 Packham ..... 30/43.92
4,797,997 1/1989 Packham ..... 30/43.92
5,131,148 7/1992 Wahl ..... 30/43.92
5,138,767 8/1992 Locke ..... 30/43.9
5,189,792 3/1993 Otsuka et al. ..... 30/43.8

FOREIGN PATENT DOCUMENTS 56-20484 2/1981 Japan .
56-23994 3/1981 Japan .
4-39878 6/1992 Japan .

*Primary Examiner*—Richard K. Seidel
*Attorney, Agent, or Firm*—Wenderoth, Lind & Ponack

[57] ABSTRACT

A electric shaver of this invention has two rows of outer blade holders. These two rows of outer blade holders connect with links allowing independent vertical movement. The links connect with a frame in a manner allowing them to move freely up and down in parallel. When one outer blade holder is strongly pushed down by the skin, the coupling mechanism of the links forces the other outer blade holder down also.

19 Claims, 16 Drawing Sheets

ELECTRIC SHAVER WITH TWO ROWS OF OUTER BLADES

BACKGROUND OF THE INVENTION

This invention relates to an electric shaver having two rows of outer blades bowed into arch configurations in outer blade holders, and in particular to an electric shaver with outer blade holders connected such that they can move up and down independently.

An electric shaver with plate-like outer blades bent into arch shapes has the characteristic that deep shaving can be achieved by making the outer blade radius of curvature small. This is because an outer blade bent with a small radius of curvature can be forcefully pressed against the skin over the small area of the curved tip. Further, an outer blade bent with a small radius of curvature can reduce unshaved whiskers and reliably give a clean shave by applying pressure against the skin with the curved tip. However, this has the drawback that when the outer blade radius of curvature is reduced, the area of contact of the outer blades with the skin is reduced, and large beard areas cannot be easily shaved by applying soft pressure to the skin with the outer blades. An electric shaver with two rows of outer blades has been developed to eliminate this problem (Japanese Patent Application 131229, 1991).

The electric shaver described in this patent application has two rows of outer blade holders, wherein each outer blade is bowed into its blade holder with a small radius of curvature. The two rows of outer blade holders are connected in a manner allowing them to move up and down. As shown in the diagrammatic representation of FIG. 11, both ends of the outer blade holders are connected to links 3. The central regions of the links 3 are in turn connected to the frame in a manner allowing see-saw motion. In this type of electric shaver, when the left outer blade holder of FIG. 11 is pushed down as indicated by arrow A, the right outer blade holder is pushed up as indicated by arrow B.

An electric shaver has also been developed wherein the outer blade holders are connected to the frame in a manner allowing each blade holder to move up and down independently, rather than dependently using a see-saw link.

These types of electric shavers have the characteristic that the two rows of outer blades continuously provide balanced pressure against the skin allowing a large area to be shaved. However, these types of electric shavers have the drawback that it is difficult to deeply shave in one area by pressing the tip of one outer blade row forcefully against the skin. The reason for this is that the two rows of outer blades are always pushed against the skin with balanced forces.

When shaving, it is desirable at first to softly apply pressure with the outer blade against a large area of skin. However, it is difficult to achieve a good, clean shave over the entire area of skin in this fashion without leaving unshaved whiskers. This is because the skin has three-dimensional protrusions and recessions, and because whiskers do not always grow in the same manner. Whiskers in recessed areas or regions where the direction of beard growth makes shaving difficult are not easily removed, and the result is blotches of unshaved whiskers. In order to reliably remove whiskers in these areas, it is necessary to forcefully apply local pressure of an outer blade to the region.

Since currently used electric shavers with two rows of outer blades apply balanced pressure to the skin from both blades, they have the drawback that the curved tip of a single outer blade cannot be forcefully pressed against the skin. This means that when it becomes necessary to remove stubborn whiskers, it is difficult to forcefully press a small portion of the outer blade against the skin. Therefore these shavers have the drawback that remaining whiskers cannot be removed by shaving deeply at certain locations.

The present invention was developed to eliminate the previously mentioned drawbacks. It is thus a primary object of the present invention to provide an electric shaver with two rows of outer blades that can apply light pressure to the skin with both outer blades, and further, when necessary apply strong pressure against the skin in a small region with a single outer blade to reliably shave difficult-to-shave regions.

SUMMARY OF THE INVENTION

The electric shaver of this invention is provided with two rows of outer blade holders housing thin plate-like outer blades bent into arch shapes. The two rows of outer blade holders are connected to a frame via links in a parallel fashion and in a manner allowing them to move up and down freely. Further, the two rows of outer blade holders are connected to the links in a manner allowing them to move up and down independently, and the links are connected to the frame in a manner allowing them to move up and down freely and in parallel. The linkage is such that when one outer blade holder is strongly pushed down by the skin, the other outer blade holder also is pushed down by coupled action through the links.

In an electric shaver of this configuration, the two rows of outer blade holders move up and down independently with the outer blades are gently pushed against the skill. In this condition the two outer blades apply balanced pressure against the skin to softly shave over a large area. When the shaver is inclined relative to the skin and a single outer blade is pushed down by being pressed strongly against the skin, the other outer blade is also pushed down. Specifically, when one outer- blade is pressed forcefully against the skin, the other outer blade holder which is not pressed forcefully against the skin is pushed down. In other words, when one outer blade is strongly pushed on, the other blade which is not pushed on is also pushed down. For this reason, a single outer blade can be pressed strongly against one region of skin to cleanly remove difficult-to-shave whiskers.

DETAILED DESCRIPTION OF THE INVENTION

Figure 1:
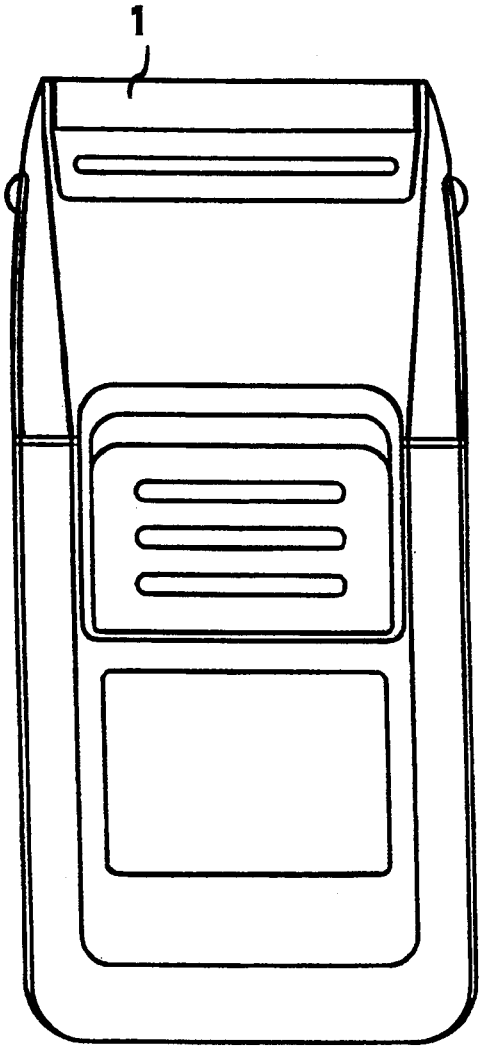
FIG. 1 is a front view showing an electric shaver with two rows of outer blades.
Figure 2:
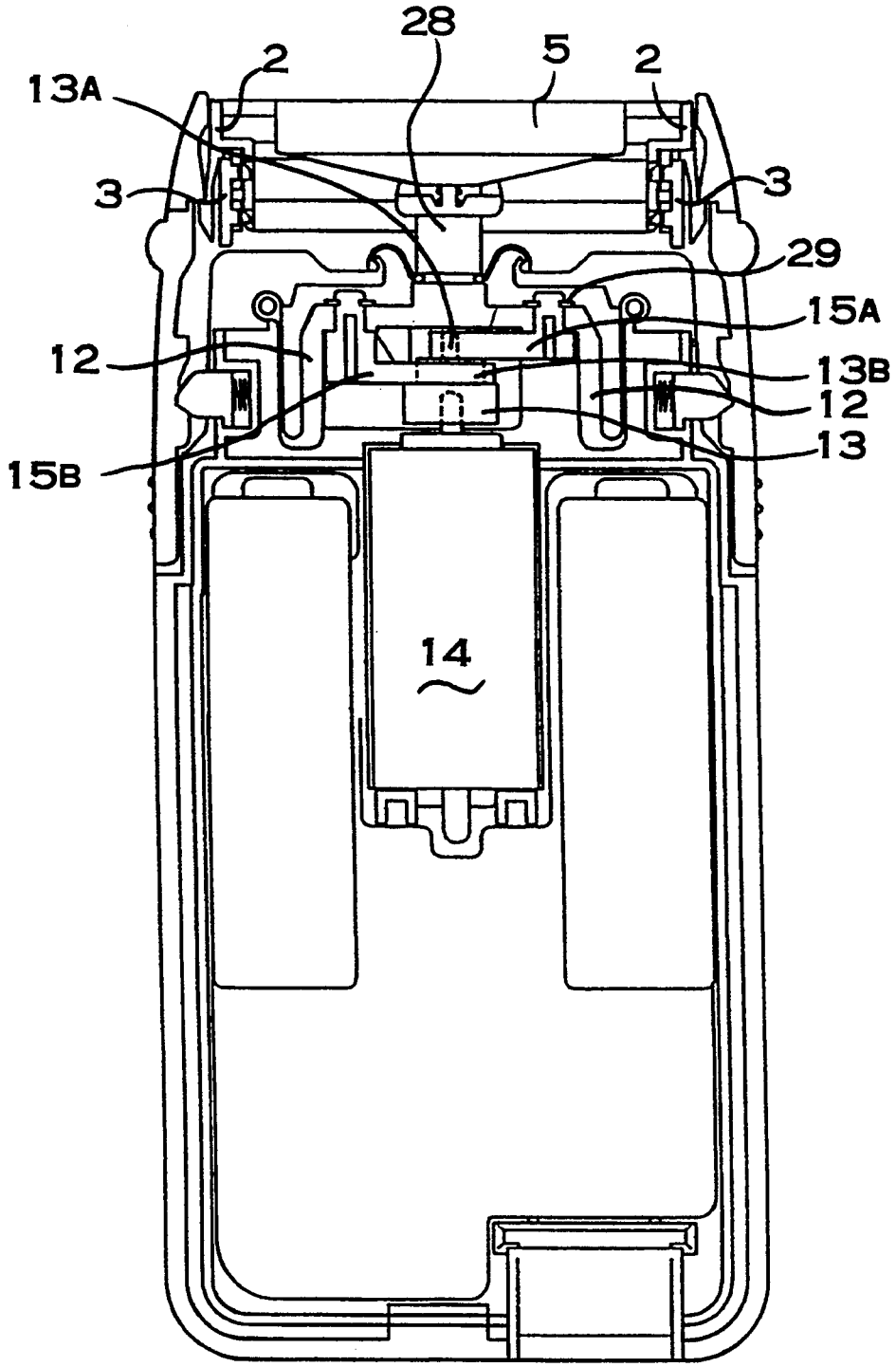
FIG. 2 is a cross-sectional front view showing the electric shaver with two rows of outer blades of FIG. 1.
Figure 3:
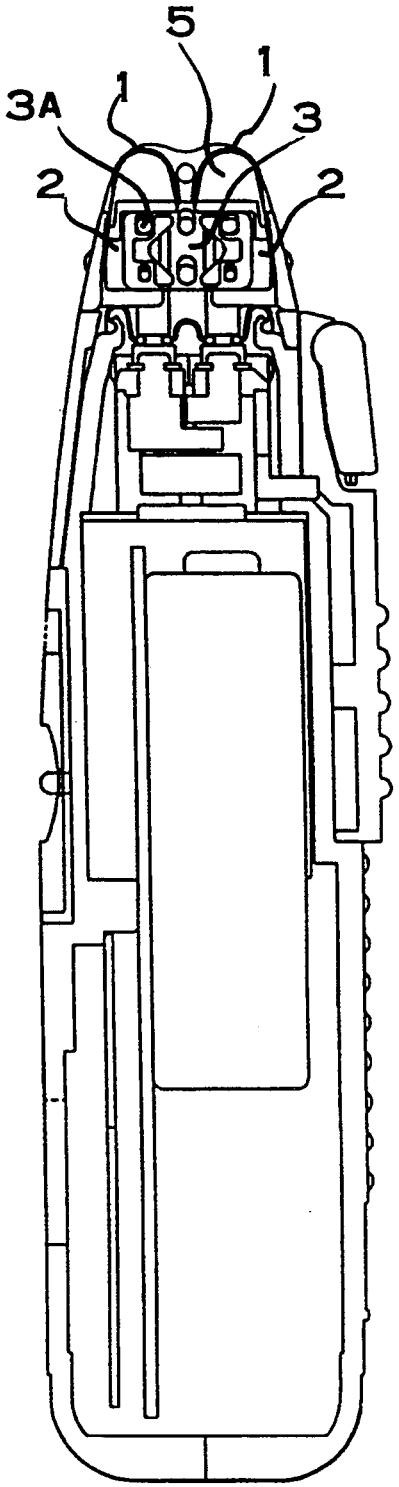
FIG. 3 is a cross-sectional side view showing the electric shaver with two rows of outer blades of FIG. 1.

The electric shaver shown in FIG. 1 through FIG. 3 is provided with two rows of outer blade holders 2 at its upper end. The two rows of outer blade holders 2 are arranged in a parallel disposition connecting with a frame 4 at both ends thereof. Thin metal plate outer blades 1 are bowed into an arch configuration within the outer blade holders 2. Inner blades 5 are arranged within the outer blades 1. The inner blades 5 are connected to a motor driven vibrator mechanism to move back and forth. The inner blades 5 push upward with flexibility.

The mechanism connecting the two rows of outer blade holders 2, giving them free movement up and down, is a feature of the electric shaver of the present invention. The driving mechanism of the inner blades 5 and the structure of inner blade 5 arrangement within the outer blade holders 2 can be adopted from either current technology or from systems to be developed in the future. The following describes in detail the outer blade holder 2 connecting system and the inner blade 5 driving mechanism.

Figure 4:
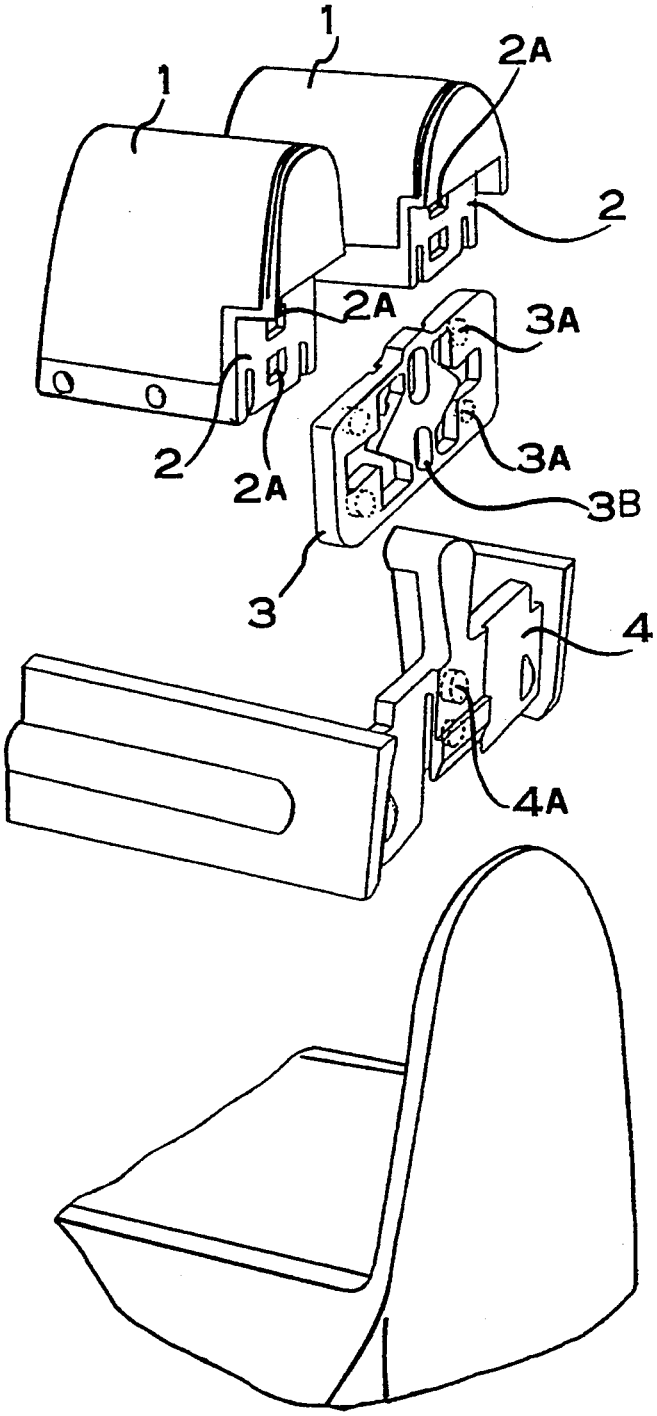
FIG. 4 is an exploded perspective view showing outer blade holders, links, and frame in an embodiment of the electric shaver of the present invention.

Turning to FIG. 4, an enlarged view showing the connection of the outer blade holders 2 to the frame 4 is illustrated. The outer blade holders 2 shown in this figure have, at their upper surfaces, outer blades 1 curved in an arch fashion and, at each end, have links 3 connected. The end planes of the outer blade holders 2 have their lower halves recessed to mate with the links 3. Boss hole 2A are provided in the recessed portion of the outer blade holders 2 to connect the blade holders 2 to the links 3. Two vertically separated boss holes 2A are opened in the recessed portion of each outer blade holder.

The inner faces of the links 3 which connect with the outer blade holders 2 are provided with projecting boss studs 3A for insertion into the boss holes 2A. Since both ends of each link 3 connect with outer blade holders 2, vertically separated boss studs 3A are provided at both ends of each link. The outer blade holders 2 are connected to the links 3 via the boss studs 3A in the boss holes 2A. The outer blade holders 2 are connected to the links 3 in a manner allowing some vertical movement. Consequently, the boss holes 2A are cut to a size allowing some vertical play for the boss studs 3A. It is desirable for the size of the boss studs 3A and the boss holes 2A to be designed to allow vertical play but not horizontal play. Boss studs 3A and boss holes 2A, having no horizontal play, support the outer blade holders 2 allowing them to move up and down, but not at an incline.

The links 3 also are provided with two connecting holes 3B in their central region. The links 3 are connected to the frame 4 via these connecting holes 3B. Since the connecting holes 3B allow the links 3 to move up and down in parallel, they are separated vertically. In order to allow vertical movement of the links 3, the connecting holes 3B are elongated in the vertical direction, taking on a long narrow shape.

Figure 5:
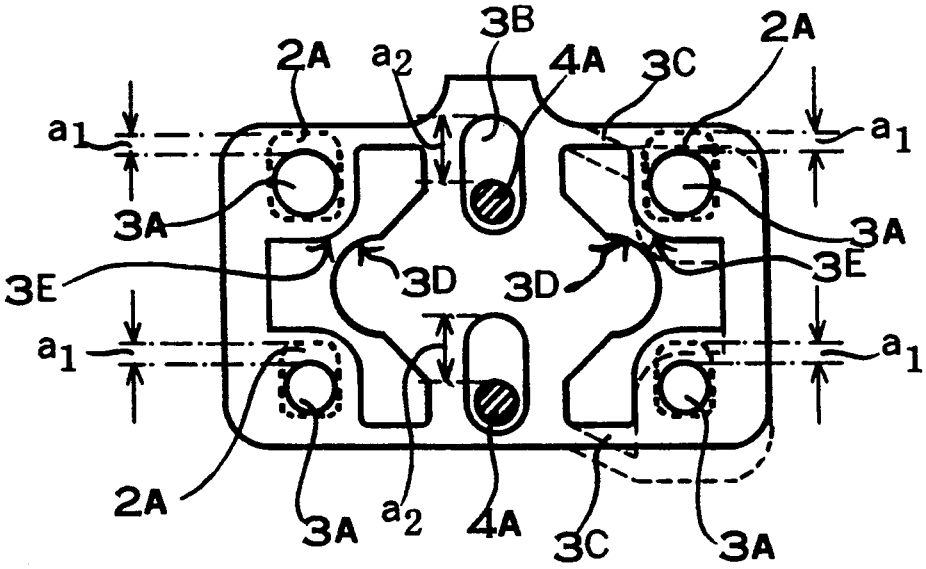
FIG. 5 is a front view of the link shown in FIG. 4.

Turning to FIG. 5, an enlarged front view of a link 3 is shown. The link 3 shown in this figure comprises a central region with connecting holes 3B, end regions with boss studs 3A, and connecting regions with thin flexible bridges 3C that flex up and down. The thin flexible bridges 5C have the flexibility to elastically deform to the position shown by broken lines when the outer blade holders 2 are pushed down. The thin flexible bridges 3C connect both end regions with boss studs 3A to the central region fashion allowing vertical displacement.

Further, the link 3 shown in FIG. 5 has a unique structure for limiting the elastic deformation of the thin flexible bridges 3C. Specifically, inclined surfaces 3D are provided on both sides of the central region, and protruding corners 3E that butt against the inclined surfaces 3D are provided in both end regions. With this type of link 3, when the boss studs 3A are strongly pressed, the thin flexible bridges 3C deform as shown by the broken lines and the boss studs 3A are pushed down. With the thin flexible bridges 3C in the deformed state, the protruding corners 3E adjacent to the boss studs 3A butt up against the inclined surfaces 3D to restrict the deformation. In this manner, a link 3 that can limit thin flexible bridge 3C deformation to a set amount has the feature that excessive deformation can be prevented when the link 3 is pushed down with an extremely strong force.

In FIG. 5, the boss holes 2A in the outer blade holders 2 are shown as dotted lines around the boss studs 3A and the connecting studs 4A of the frame 4 are shown with hatching inside the connecting holes 3B. In this FIGURE, the boss studs 3A have an amount of play inside the boss holes 2A equal to $a_1$. The connecting studs 4A are provided with an amount of play $a_2$ inside the connecting holes 3B. Therefore, the outer blade holders 2 are connected such that they can move vertically only by an amount $a_1$ relative to the links 3, and the links 3 are connected such that they can move vertically only by an amount $a_2$ relative to the frame 4.

Figure 6:
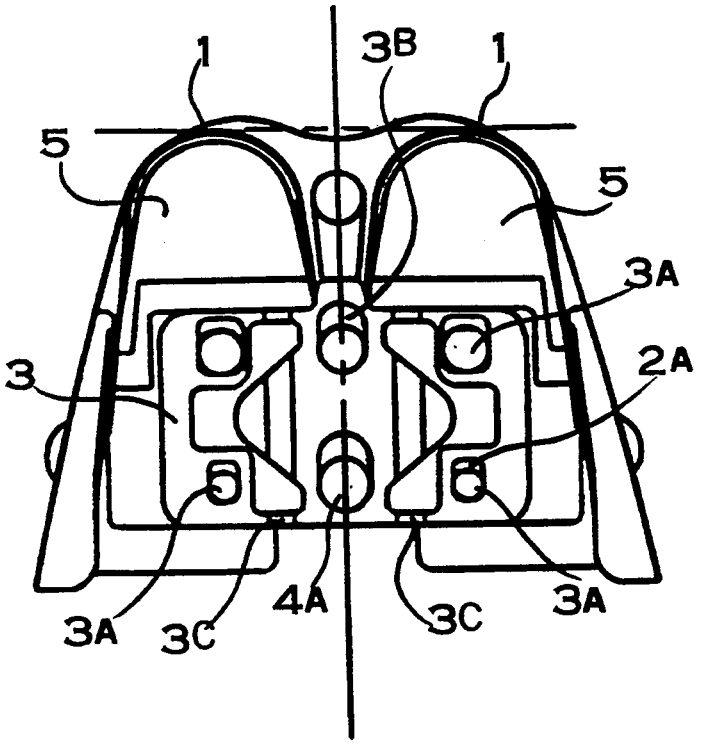
FIG. 6 is a cross-sectional side view showing the two rows of outer blade holders with no pressure applied to them.
Figure 7:
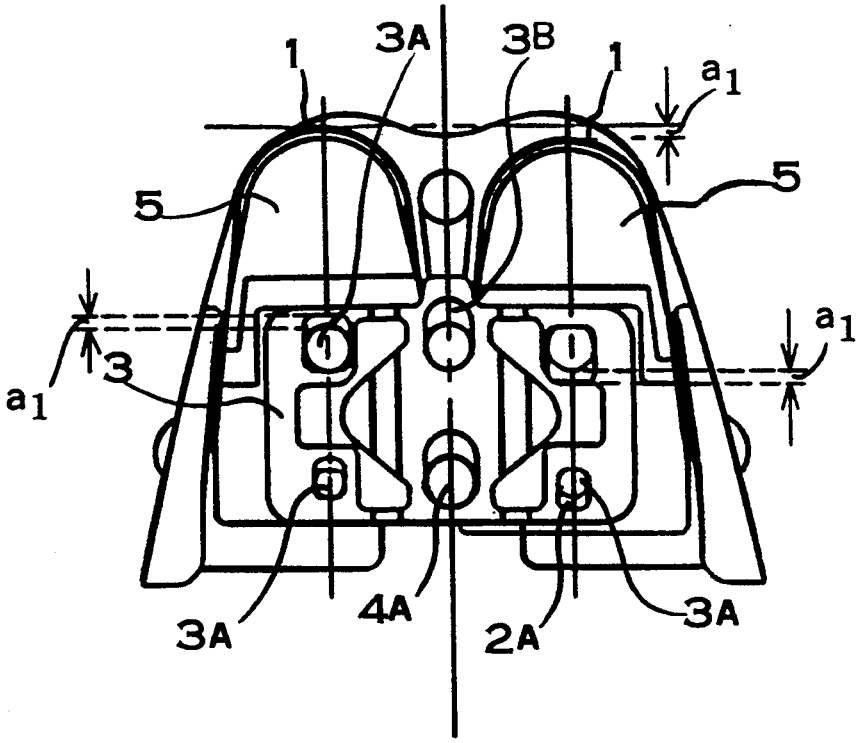
FIG. 7 is a cross-sectional side view showing light pressure applied to the right outer blade holder.
Figure 8:
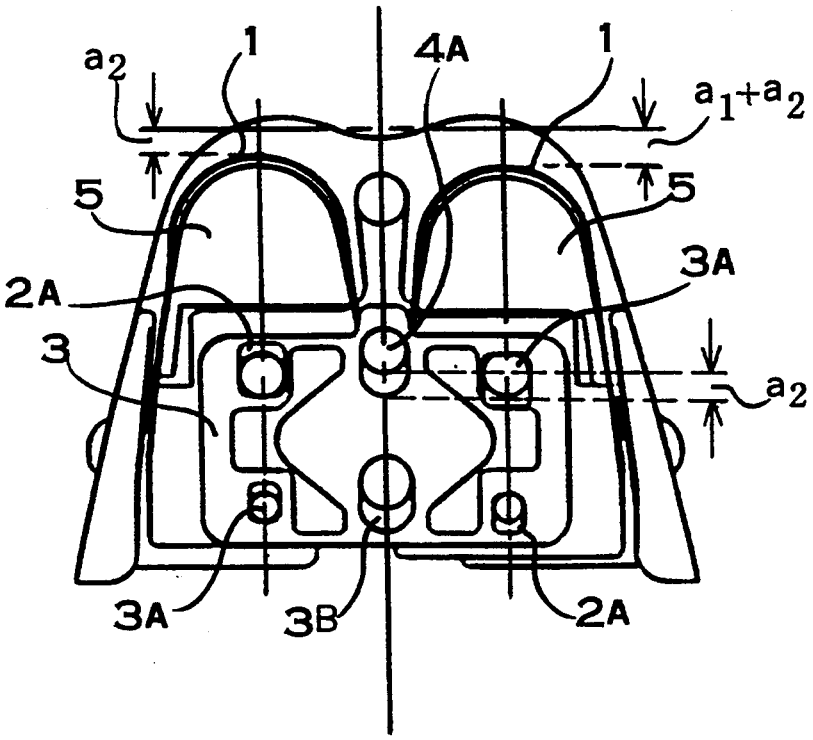
FIG. 8 is a cross-sectional side view showing strong pressure applied to the right outer blade holder.

Depression of the outer blade holders 2 with this type of link 3 is shown in FIG. 6 through FIG. 8. FIG. 6 shows the condition of the outer blade holders 2 with no pressure applied to either holder. As shown in this figure, outer blade holders 2, with no pressure applied are pushed upward by the spring-action of the inner blades 5. FIG. 7 shows light pressure applied to the right outer blade holder 2. In this condition, the right outer blade holder 2 is depressed by the distance $a_1$, which is the play between the boss studs 3A and the boss holes 2A.

The left outer blade holder 2 is not depressed. FIG. 8 shows still stronger pressure applied to the right outer blade holder 2. As shown in this FIGURE, when the right outer blade holder 2 is pressed strongly, the links 3 also get pushed down. Consequently the right outer blade holder 2 is pushed down by the distance, $a_2$, that the links 3 depress in addition to the play, $a_1$, between the boss studs 3A and the boss holes 2A. In this condition, the left outer blade holder 2 is not pressed upon, but is forced down a distance, $a_2$, due to link depression.

Figure 9:
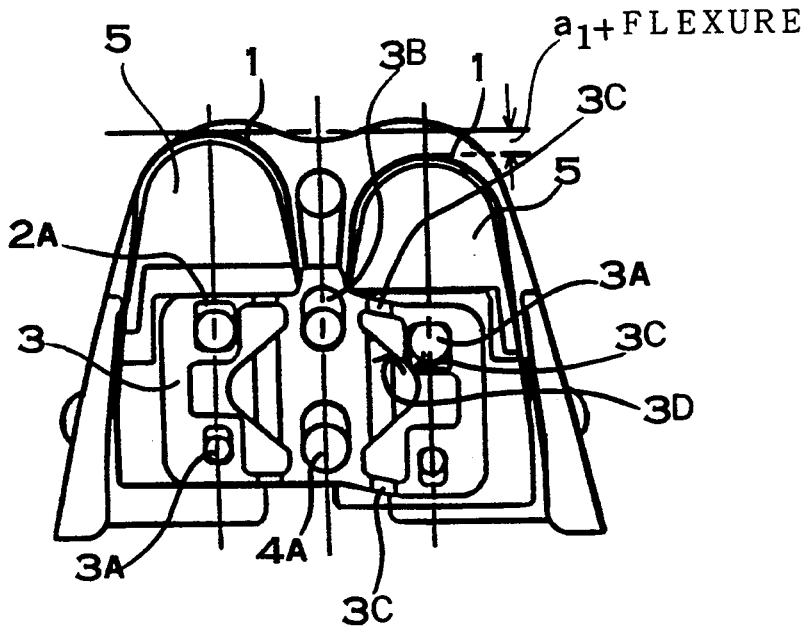
FIG. 9 is a cross-sectional side view showing pressure applied to the right outer blade holder deforming a thin flexible bridge.
Figure 10:
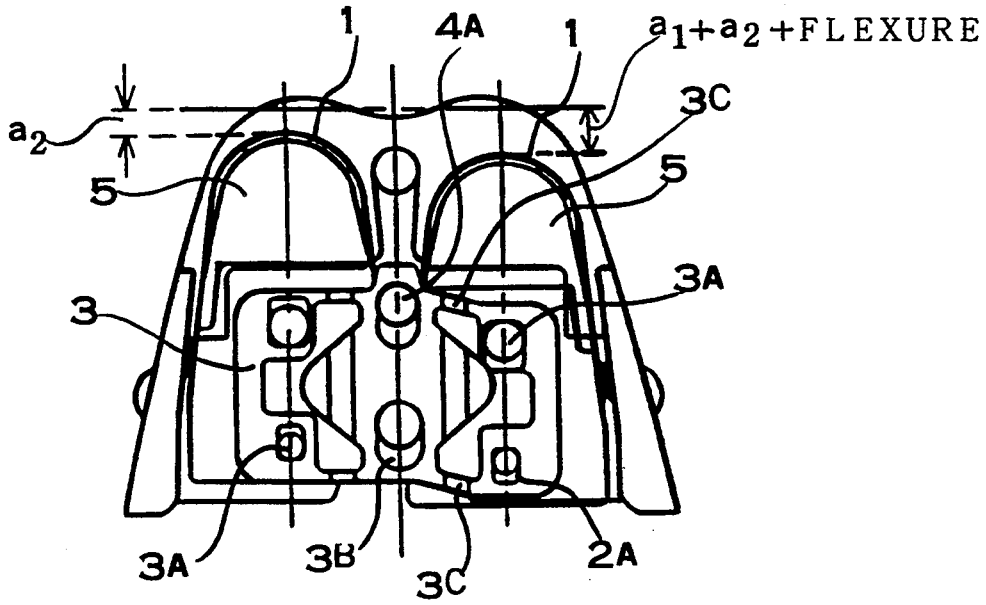
FIG. 10 is a cross-sectional side view showing still more pressure than that of FIG. 9 applied to the right, outer blade holder.
Figure 11:
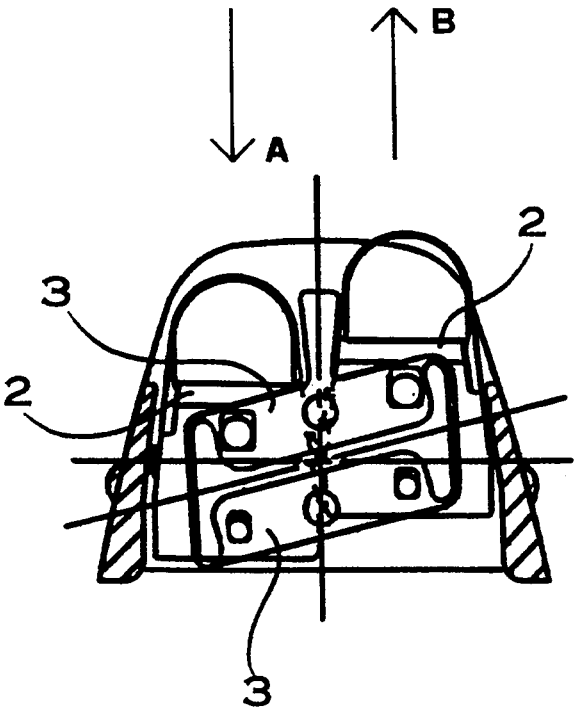
FIG. 11 PRIOR ART
FIG. 11 is a diagrammatic cross-sectional side view showing important parts of a currently used electric shaver with two rows of outer blade holders balanced by connection through links.

A link 3 with elastically deformable thin flexible bridges 3C can further increase the amount of outer blade holder 2 depression. FIG. 9 and FIG. 10 show two conditions of thin flexible bridge 3C deformation and outer blade holder 2 depression. It should be pointed out that in these figures the thin flexible bridges 3C are designed to deform at a lower force than that required to push the links 3 down. FIG. 9 shows light pressure applied to an outer blade holder 2, and FIG. 10 shows strong pressure applied to an outer blade holder 2. As shown in FIG. 9, when light pressure is applied to an outer blade holder 2, the links 3 do not depress but the thin flexible bridges 3C deform. In this case, the right outer blade holder 2 gets pushed down a distance equal to the sum of the play, $a_1$, between the boss studs 3A and the boss holes 2A, and the flexure of the thin flexible bridges 3C. The left outer blade holder 2 does not depress. As shown in FIG. 10, when strong pressure is applied to the right outer blade holder 2, and the links 3 are pushed down, the right outer blade holder 2 is depressed by $a_1+a_2+$the flexure of the thin flexible bridges 3C. The left outer blade holder 2 is forced down by the link an amount, $a_2$.

In FIG. 9 and FIG. 10, the thin flexible bridges 3C are deformed more easily than depressing the links 3. However, it is also possible to design the thin flexible bridges 3C to deform after link 3 depression.

This type of electric shaver with two rows of outer blades 1 has a unique structure that forces down an outer blade holder 2 that has not been pressed on. This is due to connection of the outer blade holders 2 with links 3. When the two rows of outer blade holders 2 are lightly pressed against the skin, each blade holder independently pushes resiliently against the skin to efficiently shave a large area with a soft touch. However, when a single outer blade holder 2 is pressed strongly to make intimate contact with the skin, the other outer blade holder 2 which is not pressed against the skin is forced downward in a direction away from the skin. The purpose of this action is to shave difficult-to-shave whiskers. In this case, the outer blade holder 2 which is not strongly pressed either applies weak pressure to the skin or does not contact the skin, and the outer blade holder 2 that is pressed strongly against the skin can reliably remove difficult-to-shave whiskers. Therefore, the electric shaver of the present invention has the feature that a wide area of beard can be efficiently shaved by soft contact with the skin with both outer blade holders 2, and whiskers in difficult-to-shave areas can be reliably removed by pressing a single outer blade holder 2 strongly against the skin.

In the electric shaver shown in FIG. 2 through FIG. 10, connecting studs 4A are provided in the frame 4, and these connecting studs 4A insert into connecting holes 3 in the links 3, thereby connecting the links 3 to the frame 4. Although not illustrated, the electric shaver may have the studs and holes interchanged. Specifically, it is also possible to connect the links 3 and frame 4 by studs on the links being inserted into connecting holes on the frame. Further, in the electric shaver shown in the above mentioned figures, the outer blade holders 2 connect with links 3 by insertion of boss studs 3A provided on the links 3 into boss holes 2A provided in the outer blade holders 2. Although not illustrated, the studs and holes of this connection may also be reversed. Specifically, it is also possible to connect the outer blade holders and the links by boss studs on the outer blade holders being inserting into boss holes on the links.

Figure 12:
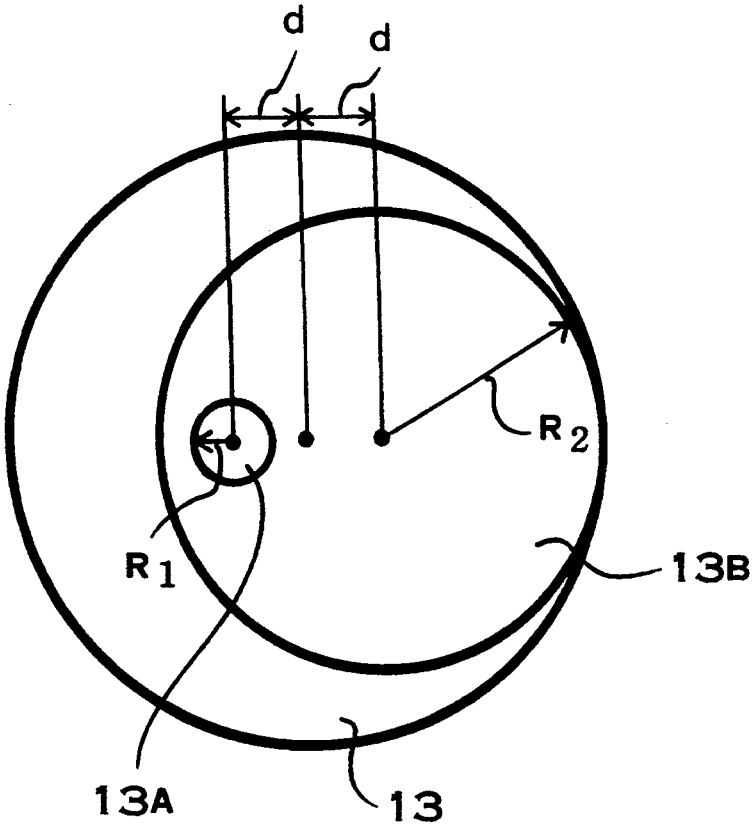
FIG. 12 is a plan view showing two levels of eccentric shafts and a center of rotation of an eccentric cam.

The electric shaver driving mechanism shown in FIG. 2 converts motor 14 rotation into back and forth motion through an eccentric cam 13 and connecting rods 28. The eccentric cam 13 is fixed to the shaft of the motor 14. The eccentric cam 13 has two eccentric shafts 13A and 13B, each with an associated connecting rod 28. The eccentric, cam 13 has two shaft centers for the two eccentric shafts 13A and 13B such that the two rows of inner blades 5 vibrate in mutually opposite directions. The eccentric shafts 13A and 13B have mutually opposite eccentricities with respect to the center of rotation. The center of each eccentric shaft is symmetric with respect to the eccentric cam 13 center of rotation and the vibration stroke of each inner blade 5 is the same. FIG. 12 shows a plan view of the eccentric cam 13. In the eccentric cam 13 of this FIGURE, The upper eccentric shaft 13A is mounted on the end of the lower eccentric shaft 13B of opposing eccentricity. The lower eccentric shaft 13B of this eccentric cam 13 is made wide. In FIG. 12, the distance between the center of the eccentric cam 13 and the eccentric shafts 13A and 13B is d, the radius of the upper eccentric shaft 13A is R1, the radius of the lower eccentric shaft 13A. is R2, and $R2 \geqq 2d+R1$. Consequently, the lower eccentric shaft 13B of this eccentric cam 13 is required to be considerably larger than the upper eccentric shaft 13A.

Eccentric shafts with different widths cannot vibrate the two inner blade 5 rows in the same manner. The lower connecting rod 15B that connects to the wider lower eccentric shaft 13B has more frictional resistance because of its large area of rubbing contact with the lower eccentric shaft 13B. The upper connecting rod 15A that connects to the narrower upper eccentric shaft 13A has a small contact area and a small amount of frictional resistance. In particular, the upper connecting rod 15A connects with the eccentric cam 13 in a manner that easily allows vibration while, on the other hand, the lower connecting rod 15B connects with eccentric cam 13 in a manner that does not allow light vibration. Consequently, the two inner blade vibrators 12 connect with the eccentric cam 13 in an unbalanced state, and one side of the two inner blade 5 rows becomes easy to stop, reducing the cutting ability. Further, friction between the wide lower eccentric shaft 13B and the lower connecting rod 15B is large, increasing the load current when driven, reducing the efficiency of initial movement, and reducing the number of shaves between recharging. Further, when the frictional area is large, the blades become more sensitive to load fluctuations.

Figure 13:
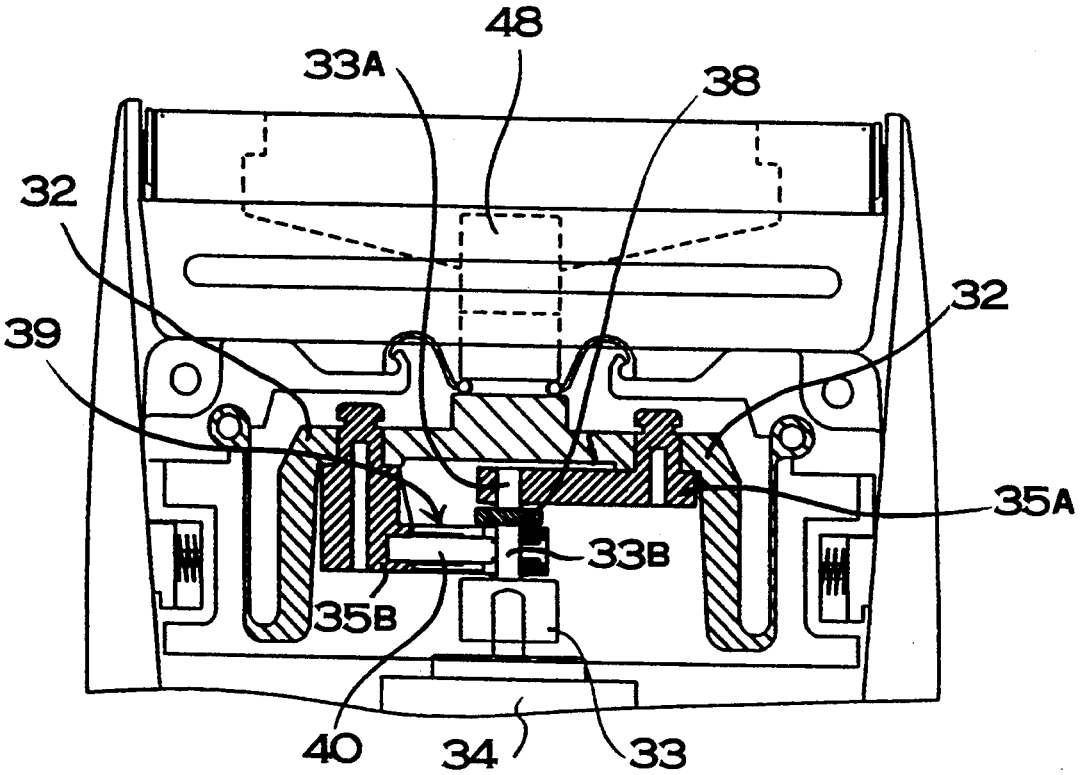
FIG. 13 i s a cross-sectional front view showing an upper portion of one embodiment of the electric shaver of the present invention.
Figure 14:
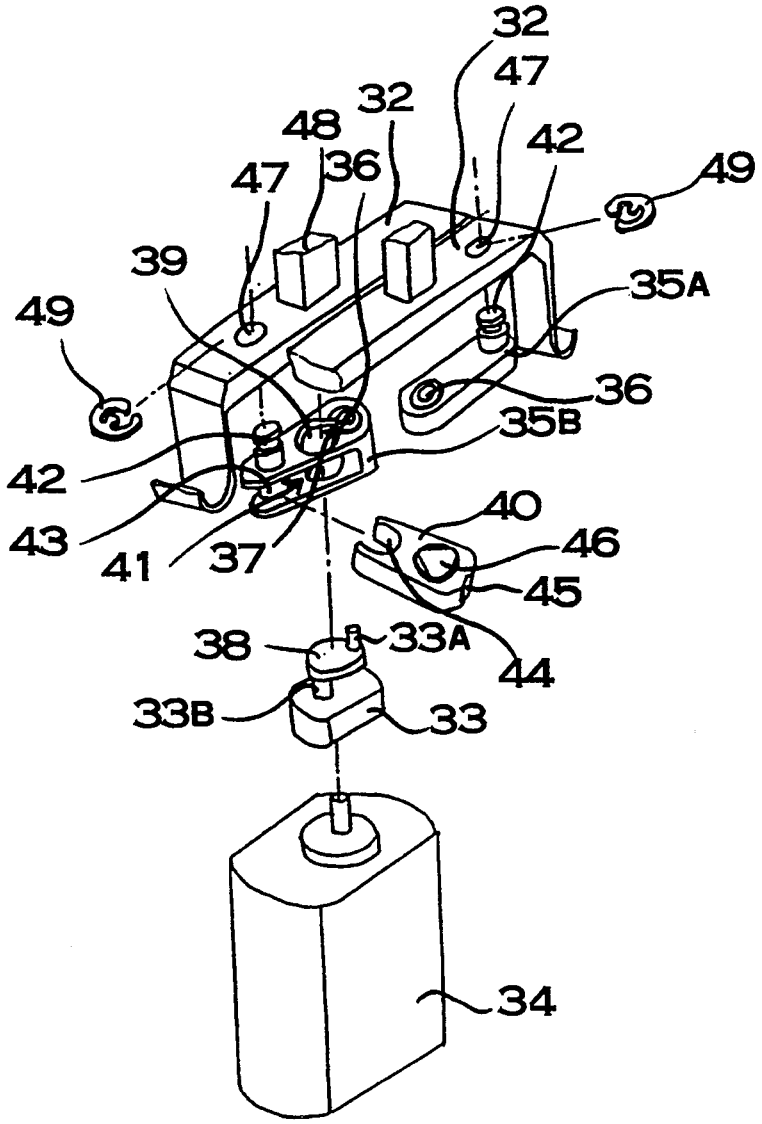
FIG. 14 is an exploded perspective view showing the driving mechanism for the inner blade vibrators of the electric shaver of FIG. 13.

These problems are solved by an electric shaver having the configuration shown in FIG. 13 and FIG. 14. The electric shaver shown in these figures comprises a motor 34, an eccentric cam 33 that converts the rotational motor of the motor 34 into reciprocal motion, and two rows of inner blade vibrators 32 connected to eccentric shafts 33A and 33B of the eccentric cam 33 through connecting rods 35A and 35B.

The eccentric cam 33 is connected to the rotating shaft of the motor 34. The eccentric cam 33 moves the two rows of inner blade vibrators 32 back and forth in opposite directions through the two connecting rods 35A and 35B. Consequently, the eccentric earn 33 has its two eccentric shafts 33A and 33B located at opposite eccentricities about the center of rotation. The two eccentric shafts 33A and 33B connect with rotation holes 36 in the two separately moving connecting rods 35A and 35B. The vertically separated eccentric shafts 33A and 33B vibrate the two connecting rods 35A and 35B in opposite directions.

The gap between the two eccentric shafts 33A and 33B and the eccentric cam 33 center of rotation is designed to be equal in order to make the back and forth stroke of the two inner blade vibrators 32 equal. The eccentric cam 33 shown in FIG. 14 is provided with a disk 38 between the upper and lower eccentric shafts 33A and 33B. The upper upper eccentric shaft 33A is connected to the lower lower eccentric shaft 33B through this disk 38.

It is desirable to design the two upper and lower eccentric shafts 33A and 33B equal in width. However, it is not always necessary to make the widths of the two eccentric shafts 33A and 33B exactly the same. For example, it is possible to make the lower eccentric shaft 33B about 50% larger than the upper eccentric shaft 33A.

The two connecting rods 35A and 35B that connect to the eccentric shafts 33A and 33B are configured as an upper connecting rod 35A and a lower connecting rod 35B. Further, the lower connecting rod 35B is fit with a locking piece 40 to prevent separation from the lower eccentric shaft 33B.

The lower connecting rod 35B is provided with a central gap 41 to allow insertion of the locking piece 40. Further, as shown in FIG. 14, the left end of the lower connecting rod 35B is provided with a stud 42 to connect with an inner blade vibrator 32. A pin 43 is provided within the gap 41 directly in line with the stud 42. Further, a rotation hole 36 is provided -for insertion of the lower eccentric shaft 33B vertically through the right end (in this figure) of the lower connecting rod 35B. A disk hole 39 is cut vertically through the rotation hole 36. The disk hole 39 is designed with an inside diameter allowing the eccentric cam 33 disk 38 to pass there-through. The rotation hole 36 is connected with the disk hole 39 through a notch 37.

The notch 37 is provided to guide the lower eccentric shaft 33B, inserted into the disk hole 39, into the rotation hole 36. When the lower eccentric shaft 33B moves from the disk hole 39 to the rotation hole 36, the notch 37 becomes somewhat enlarged. The lower connecting rod 35B is therefore formed from a material, such as hard plastic that allows some elastic deformation. It is desirable to design the notch 37 width smaller than the diameter of the lower eccentric shaft 33B to prevent the lower eccentric shaft 33B from falling out of the rotation hole 36 after it is inserted therein from the notch 37. However, as shown in the Figure, the purpose of the locking piece 40 is to prevent the lower eccentric shaft 33B from falling out of the rotation hole 36, and it is not always necessary to make the notch 37 width smaller than the diameter of the lower eccentric shaft 33B.

The locking piece 40 for preventing the lower eccentric shaft 33B from falling out of the rotation hole 36 fits into the gap 41 in the lower connecting rod 35B. The locking piece 40 shown in FIG. 14 comprises a concavity 44 at its left end mating with the pin 43 in the gap 41, a channel 45 at its right end mating with the lower eccentric shaft 33B inserted in the rotation hole 36, and a protrusion 46 on its upper right side mating with the disk hole 39.

The upper connecting rod 35A is provided with a rotation hole 36 at one end to connect with the upper eccentric shaft 33A of the eccentric cam 33, and with a stud 42 at the other end to connect with an inner blade vibrator 32. The rotation holes 36 in both connecting rods 35A and 35B are designed equal to or slightly larger than the outer diameters of the eccentric shafts 33A and 33B such that those shafts 33A and 33B are inserted within the rotation holes 36 in a manner allowing free rotation. Further, the ends of the studs 42 on the connecting rods 35A and 35B are provided with grooves for the insertion of E-links 49. Both connecting rods 35A and 35B are connected to vibrator platens through the studs 42, which fit into connecting holes 47 of the inner blade vibrators 32. The studs 42, which fit through the connecting holes 47 in the vibrator platens, have E-links 49 locked on their ends. The E-links 49 prevent disconnection of both connecting rods 35A and 35B from the vibrator platens.

This configuration of connecting rods 35A and 35B and eccentric cam 33 are put together in the following fashion.

(1) The lower eccentric shaft 33B of the eccentric cam 33 connects with the lower connecting rod 35B. As shown in FIG. 14, the disk 38 of the eccentric cam 33 is put through the disk hole 39 of the lower connecting rod 35B to guide the lower eccentric shaft 33B into the disk hole 39. Next, the lower eccentric shaft 33B is guided through the notch 37 to connect into the rotation hole 36. At this time the locking piece 40 is disconnected from the lower connecting rod 35B. The locking piece 40 connects with the lower connecting rod 35B as shown in FIG. 15 through FIG. 20.

Figure 15:
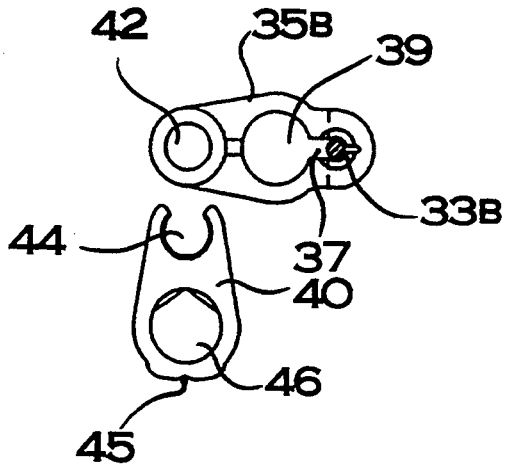
FIG. 15 through FIG. 20 are plan views showing the lower connecting rod and the locking piece.
Figure 16:
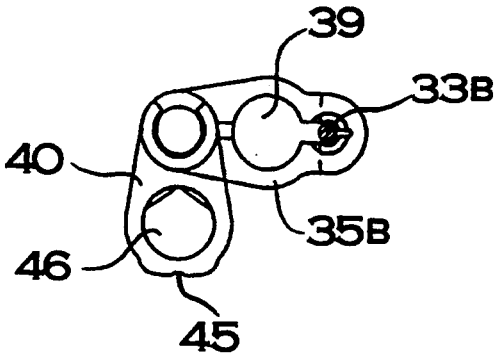

(2) Specifically, as shown in FIG. 15 and FIG. 16, the concavity 44 in the locking piece 40 mates with the pin 43 at the left side of the gap 41 in the lower connecting rod 35B.

Figure 17:
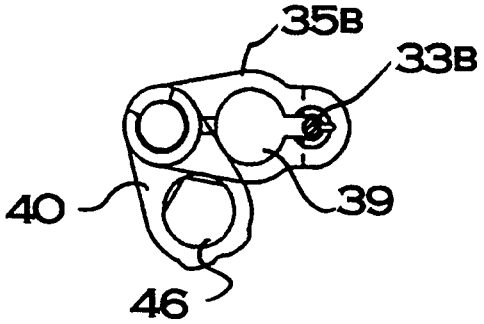
Figure 18:
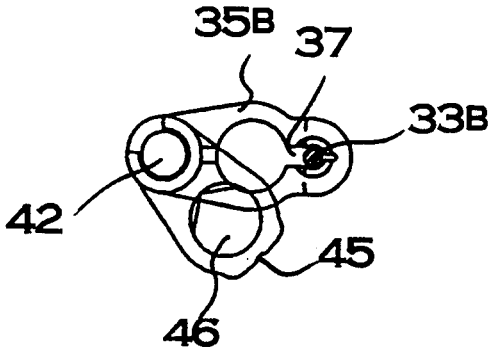
Figure 19:
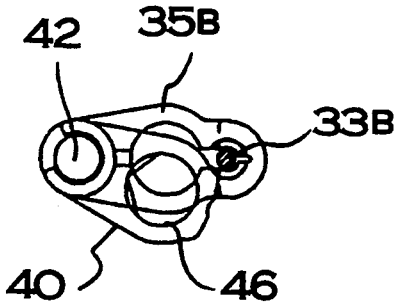

(3) As shown in FIG. 17 through FIG. 19, the locking piece 40 is moved rotationally.

Figure 20:
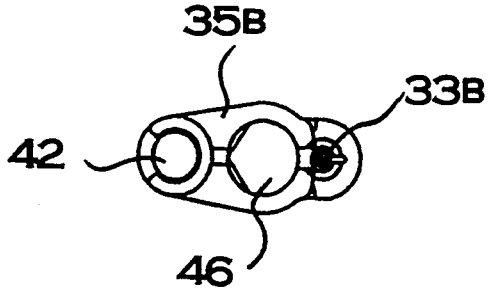

(4) As shown in FIG. 20, The locking piece 40 is completely pushed into the gap 41 of the lower connecting rod 35B and the protrusion 46 on top of the locking piece 40 is pushed into the disk hole 39. The protrusion 46 locks into the disk hole 39 preventing the locking piece 40 from coming out of the gap 41 in the lower connecting rod 358. In this orientation, the groove 45 in the locking piece 40 mates with the eccentric shaft 33B. The groove 45 in the locking piece 40 holds the lower eccentric shaft 33B in place and prevents it from coming out of the rotation hole 36

(5) The upper eccentric shaft 33A inserts into the rotation hole 36 of the upper connecting rod 35A.

(6) The studs 42 on the upper connecting rod 35A and the lower connecting rod 35B insert into the connecting holes 47 in the vibrator platens and E-links 49 are locked on their ends.

Figure 21:
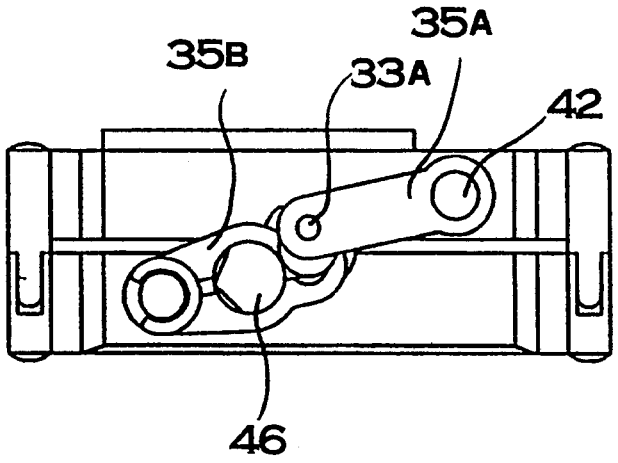
FIG. 21 through FIG. 23 are plan views showing the relative locations of the eccentric cam and the connecting rods.
Figure 22:
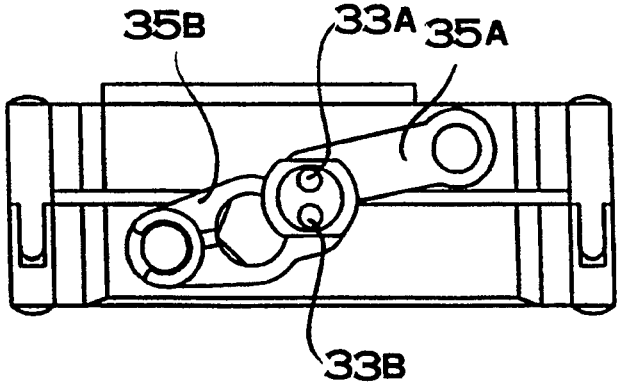
Figure 23:
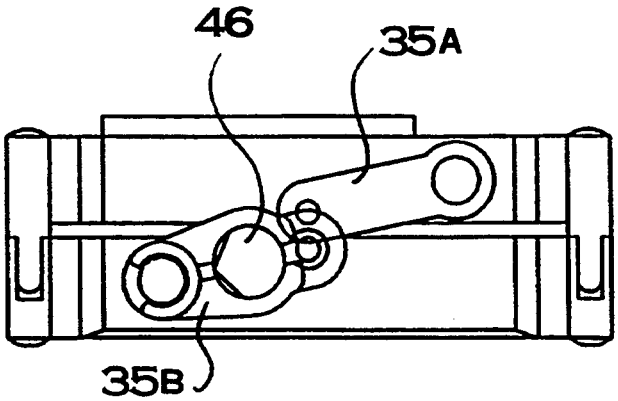

FIG. 21 through FIG. 23 show the relative positions of both connecting rods 35A and 35B and the eccentric cam 33. FIG. 21 shows both connecting rods 35A and 35B connected with the eccentric cam 33 as seen from above. FIG. 22 shows the positions of both levels of eccentric shafts 33A and 33B on the eccentric cam 33, and FIG. 23 shows the relative positions of the connecting rods 35A and 35B.

The two rows of inner blades 5 are connected to the inner blade vibrators 32. The two rows of inner blade vibrators 32 are disposed in a parallel fashion such that they can vibrate in mutually parallel directions, and they connect to the case through flexible strips. The inner blade vibrators 32 are provided with connecting rods 48 that protrude upward and connect with the inner blades 5.

We claim:

1. An electric shaver, comprising:

two rows of outer blade holders having outer arch shaped blades disposed thereon:

a frame having a plurality of connecting studs thereon; and links connecting said two rows of outer blade holders to each other and to said frame, wherein said links have narrow elongated connecting holes therein extending in one direction, said connecting studs of said frame are inserted into said connecting holes, and play is present between said connecting studs and said connecting holes such that said links can move in the one direction relative to said frame.

2. The electric shaver of claim 1, wherein each said link has two said connecting holes located at a central region thereof and separated from each other in the one direction.

3. An electric shaver, comprising:

two rows of outer blade holders having outer arch shaped blades disposed thereon, said outer blade holders having end surfaces with boss holes therein;

a frame; and links connecting said two rows of outer blade holders to each other and to said frame, wherein said links have boss studs inserted into said boss holes, and play is present between said boss studs and said boss holes in one direction such that said outer blade holders can move in the one direction relative to said links.

4. The electric shaver of claim 3, wherein each said end surface of said outer blade holders has two said boss holes therein located at a central region thereof and separated from each other in the one direction, and each said link has two said boss studs on each side of said central region thereof, the two said boss studs on each side of said central region of each said link being separated from each other in the one direction.

5. An electric shaver, comprising:

two rows of outer blade holders having outer arch shaped blades disposed thereon;

a frame; and linking means for connecting said two rows of outer blade holders to each other and to said frame such that said two rows are moveable in one direction relative to said frame and parallel to each other, said two rows are moveable in the one direction over a predetermined distance independently of each other, and said two rows are moved together when one of said two rows is caused to move beyond the predetermined distance.

6. The electric shaver of claim 5, wherein said linking means comprises links, connected to both said rows of outer blade holders such that said two rows are moveable in the one direction relative to said links independently of each other, and connected to said frame such that said links are moveable together with said two rows in the one direction relative to said frame.

7. The electric shaver of claim 6, wherein said links of said linking means are elastically deformable over a predetermined range in the one direction.

8. The electric shaver of claim 6, wherein each said link has a central region connected with said frame, side regions on sides of said central region connected with said outer blade holders and thin flexible bridges joining said central region with said side regions.

9. The electric shaver of claim 6, wherein said links have narrow elongated connecting holes therein extending in the one direction, said frame has connecting studs inserted into said connecting holes and play is present between said connecting studs and said connecting holes such that said links can move in the one direction relative to said frame.

10. The electric shaver of claim 9, wherein each said link has two said connecting holes located at a central region thereof and separated from each other in the one direction.

11. The electric shaver of claim 6, wherein said outer blade holders have end surfaces with boss holes therein, said links have boss studs inserted into said boss holes, and play is present between said boss studs and said boss holes in the one direction such that said outer blade holders can move in the one direction relative to said links.

12. The electric shaver of claim 11, wherein each said end surface of said outer blade holders has two said boss holes therein located at a central region thereof and separated from each other in the one direction, and each said link has two said boss studs on each side of a central region thereof, the two said boss studs on each side of said central region of each said link being separated from each other in the one direction.

13. An electric shaver, comprising:

two rows of outer blade holders having outer arch shaped blades disposed thereon;

a frame; and links connecting said two rows of outer blade holders to each other and to said frame, said links being structured and arranged in interconnecting said two rows and connecting said two rows with said frame such that said two rows are moveable in one direction relative to said frame and parallel to each other such that, when a first force is applied to one said row, the one said row is moveable over a first predetermined distance in the one direction independent of the other said row, but when the one said row is moved beyond the first predetermined distance in the one direction is response to a second, stronger force being applied thereto, said two rows are both moved in the one direction.

14. The electric shaver of claim 13, wherein said links have narrow elongated connecting holes therein extending in the one direction, said frame has connecting studs inserted into said connecting holes and play is present between said connecting studs and said connecting holes such that said links can move in the one direction relative to said frame.

15. The electric shaver of claim 14, wherein each said link has two said connecting holes located at a central region thereof and separated from each other in the one direction.

16. The electric shaver of claim 13, wherein said outer blade holders have end surfaces with boss holes therein, said links have boss studs inserted into said boss holes, and play is present between said boss studs and said boss holes in the one direction such that said outer blade holders can move in the one direction relative to said links.

17. The electric shaver of claim 16, wherein each said end surface of said outer blade holders has two said boss holes therein located at a central region thereof and separated from each other in the one direction, and each said link has two said boss studs on each side of said central region thereof, the two said boss studs on each side of said central region of each said link being separated from each other in the one direction.

18. The electric shaver of claim 13, wherein each said link has a central region connected with said frame, side regions on sides of said central region connected with said outer blade holders and thin flexible bridges joining said central region with said side regions such that said thin flexible bridges are elastically deformable upon force being applied to one of said outer blade holders.

19. The electric shaver of claim 18, wherein said outer blade holders have end surfaces with boss holes therein, said links have boss studs inserted into said boss holes, and play is present between said boss studs and said boss holes in the one direction such that said outer blade holders can move in the one direction relative to said links.

* * * * *